US006796792B1

(12) United States Patent
Aleardi et al.

(10) Patent No.: US 6,796,792 B1
(45) Date of Patent: Sep. 28, 2004

(54) ELECTRONIC GAS-LIGHTING DEVICE INTEGRATED WITH A TERMINAL BOARD

(75) Inventors: Massimo Aleardi, Cassano Magnago (IT); Raoul Bianchi, Villa Guardia (IT)

(73) Assignee: ITW Industrial Components S.R.L. (IT)

( * ) Notice: Subject to any disclaimer, the term of this patent is extended or adjusted under 35 U.S.C. 154(b) by 0 days.

(21) Appl. No.: 09/744,587

(22) PCT Filed: Jul. 28, 1999

(86) PCT No.: PCT/IT99/00247

§ 371 (c)(1),
(2), (4) Date: Mar. 20, 2001

(87) PCT Pub. No.: WO00/06952

PCT Pub. Date: Feb. 10, 2000

(30) Foreign Application Priority Data

Jul. 28, 1998 (IT) ..... TO98A0653

(51) Int. Cl.[7] ..... F23Q 3/00

(52) U.S. Cl. ..... 431/258; 126/39 BA; 361/253

(58) Field of Search ..... 431/258, 263, 431/264, 255, 254; 126/39 BA, 39 E; 361/253, 263, 600, 679, 728, 736, 752; 315/363, 362

(56) References Cited

U.S. PATENT DOCUMENTS

| | | | | | |
|---|---|---|---|---|---|
| 3,421,825 | A | * | 1/1969 | Maycock | 431/263 |
| 4,222,089 | A | * | 9/1980 | MacAskill et al. | 431/263 |
| 4,392,810 | A | * | 7/1983 | Bears et al. | 431/37 |
| 4,413,611 | A | * | 11/1983 | Berlik et al. | 126/39 E |
| 4,683,518 | A | * | 7/1987 | Gwozdz | 431/264 |
| 5,274,529 | A | * | 12/1993 | Mura et al. | 361/679 |
| 5,455,744 | A | * | 10/1995 | Watanabe | 361/801 |
| 5,525,771 | A | * | 6/1996 | Lund | 431/256 |
| 5,545,034 | A | * | 8/1996 | Le Monnier De Gouville | 431/255 |
| 6,382,961 | B2 | * | 5/2002 | Clifford et al. | 431/264 |
| 6,429,606 | B1 | * | 8/2002 | Aleardi et al. | 315/363 |
| 6,506,047 | B1 | * | 1/2003 | Aleardi et al. | 431/258 |

FOREIGN PATENT DOCUMENTS

| | | | | |
|---|---|---|---|---|
| DE | 43 00 309 | | 7/1994 | |
| DE | 295 00 327 | | 2/1995 | |
| EP | 0 819 890 | | 1/1998 | |
| JP | 5-302715 | A * | 11/1993 | F23Q/3/00 |
| JP | 8-97058 | A * | 4/1996 | F23Q/3/00 |
| JP | 09 060878 | | 3/1997 | |

* cited by examiner

*Primary Examiner*—Josiah Cocks
(74) *Attorney, Agent, or Firm*—Lowe Hauptman Gilman & Berner LLP

(57) ABSTRACT

An electronic gas-lighting device includes a casing made of insulating material; electronic high-voltage-pulse generating circuit including at least one transformer having a secondary winding, the ends of which are connected to respective high-voltage terminals; and fitting elements for removably fitting the insulating casing to a supporting surface of a conducting metal body element of an electric household appliance, e.g., a cooking range with gas burners. The casing includes a cup-shaped body housing the transformer, and a box portion which is formed integrally with the cup-shaped body, houses at least part of the electronic high-voltage-pulse generating circuit, and is fitted directly with respective supply contacts located on the box portion to form a supply terminal board. The supply contacts are connected exclusively to the electronic high-voltage-pulse generating circuit, and are connectable to the wires of a supply cable.

20 Claims, 1 Drawing Sheet

ELECTRONIC GAS-LIGHTING DEVICE INTEGRATED WITH A TERMINAL BOARD

TECHNICAL FIELD

The present invention relates to an electronic gas-lighting device integrated with a supply terminal board and so connectable directly to the wires of a supply cable.

BACKGROUND ART

Increasing demand for integrated components is also felt in the electric household appliance industry to simplify and speed up component assembly to the appliance, and in particular to the appliance body. In the case of gas cookers, and also built-in cooking ranges, components typically fitted to the appliance body, or to the cooking range, are the electronic gas-lighting device and the supply terminal board. The terminal board is designed to receive and retain the cable powering the various electric devices (e.g. lights, burner lighter, etc.) and, above all, to ground the appliance body and/or cooking range, which are conducting metal elements. The electronic gas-lighting device, on the other hand, is the main device to be powered, and provides for lighting the burners by means of respective high-voltage terminals, which are connected by conducting wires to electrodes fitted to the range, close to the burners which, being grounded via the range, act as counterelectrodes.

The above integration problems are known to be solved using a standard terminal board having a supporting body shaped to house a standard lighting device complete with a respective independent casing, so that the lighting device is preassembled to the terminal board, which is then fitted to the appliance in one operation. Though the time taken to fit the components to the appliance is reduced, the above solution has the drawback of increasing the time taken to assemble the components and the cost of the components themselves. Moreover, in most applications, using a standard terminal board designed for high currents (e.g. 12 amps) is a pointless waste.

DISCLOSURE OF INVENTION

It is an object of the present invention to provide an integrated device designed to eliminate the aforementioned drawbacks, and which, in particular, is cheap and easy to produce, can be assembled quickly and easily, and may be used indifferently for cooking ranges or for more complex electric household appliances such as gas cookers.

According to the present invention, there is provided an electronic gas-lighting device integrated with a terminal board, the device comprising a casing made of insulating material; electronic high-voltage-pulse generating means including at least one transformer having a secondary winding, the ends of which are connected to respective high-voltage terminals; and assembly means for removably fitting said casing to a supporting surface of a conducting metal body element of an electric household appliance; in particular a cooking range with gas burners; characterized in that said casing is fitted directly with respective supply contacts located on a specially shaped portion of the casing to form a supply terminal board, which is connected exclusively and solely to said electronic high-voltage-pulse generating means, and to which are connectable the wires of a supply cable.

More specifically, the casing is made of molded synthetic plastic material, and comprises a cup-shaped body, a cavity of which houses said at least one transformer; and a box portion, which is formed integrally with the cup-shaped body, houses at least part of said electronic high-voltage-pulse generating means, and is fitted directly with said respective supply contacts which are arranged on the box portion to form, together with the box portion, said terminal board.

The terminal board may therefore be designed solely bearing in mind the maximum current relating to the gas-lighter (less than 1 amp), thus enabling a reduction in the size of the terminal board. Moreover, all the terminal board and gas-lighter components are carried by the same casing and wired directly to one another inside the casing, which provides for component saving, reducing size and weight, simplifying assembly, and possibly also electrically connecting the terminal board contacts directly to a component, e.g. a printed circuit, of the gas-lighter.

In a preferred embodiment, the terminal board contacts, which are Faston types, are clicked onto an inner first face of the box portion, and one of them, which acts as a ground contact, has a tongue projecting outwards of the box portion and parallel to and facing a second face of the box portion opposite the first, so that the appliance body (or cooking range) can be grounded by simply fitting the tongue to it. Being parallel to the axial extension of the box portion, the tongue in no way prevents the device from being inserted into or removed from the appliance, regardless of whether this is done from the inside or outside of the appliance body.

Finally, on the second face side, the box portion of the casing comprises an integral connector for connecting the high-voltage-pulse generating means to respective control means of the appliance; and the cup-shaped body carries said high-voltage terminals housed inside through ducts formed integrally with a bottom wall of the cup-shaped body perpendicular to the first and second face of the box portion, thus preventing, in use, any possible crossover of the catenary control cables and the high-voltage cables to the burners.

BRIEF DESCRIPTION OF DRAWINGS

A non-limiting embodiment of the present invention will be described by way of example with reference to the accompanying drawings, in which.

BEST MODE FOR CARRYING OUT THE INVENTION

Figure 1:
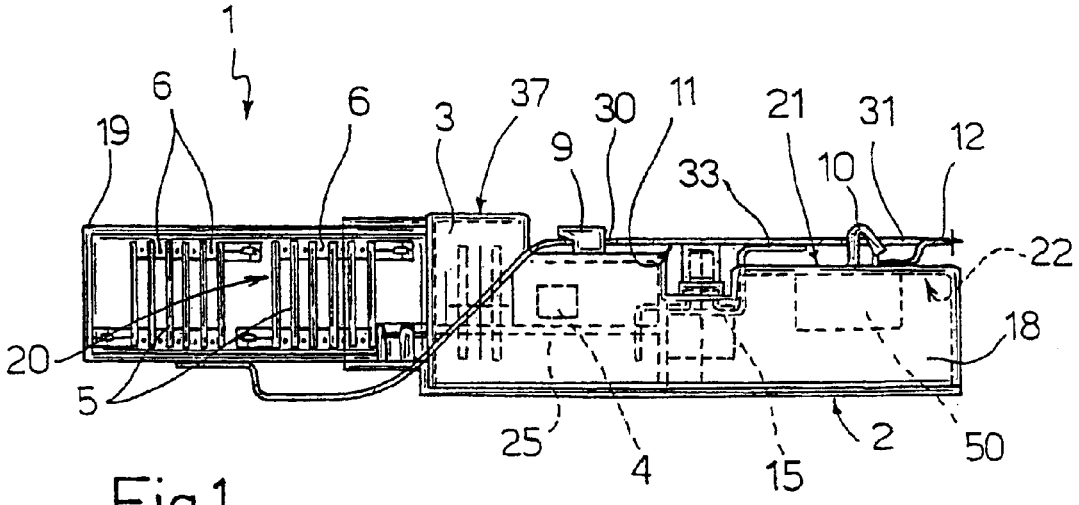
FIG. 1 shows a longitudinal elevation of the integrated device according to the invention.
Figure 2:
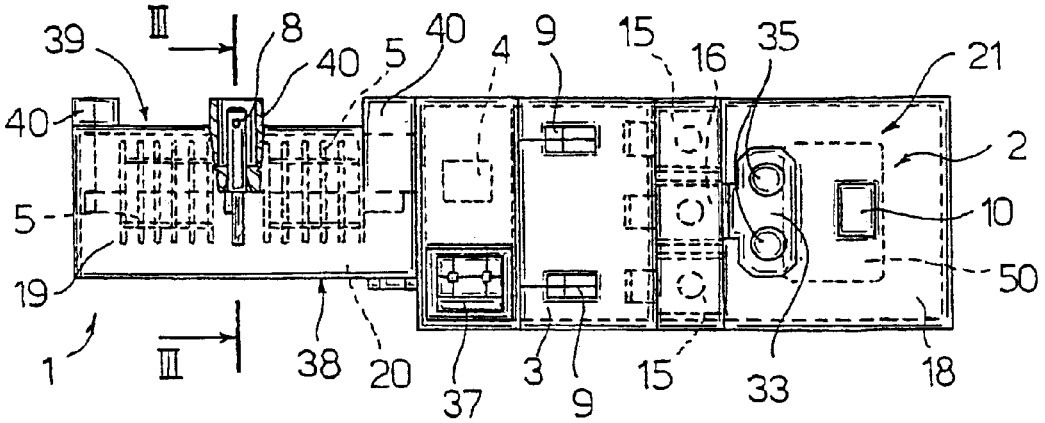
FIG. 2 shows a partially sectioned longitudinal view of the FIG. 1 device rotated 90°.
Figure 3:
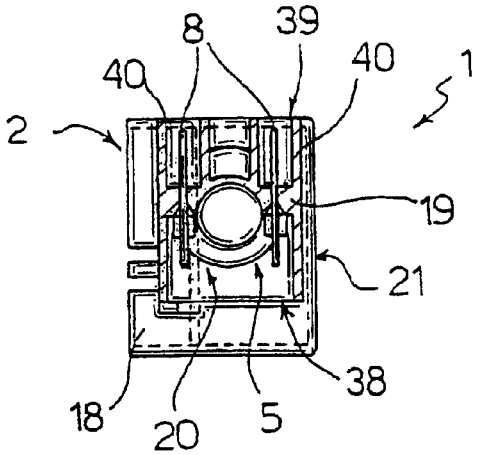
FIG. 3 shows a section along line III—III of the FIG. 2 device.

Number 1 in FIGS. 1 to 3 indicates as a whole an electronic gas-lighting device, which, according to the invention, is integrated with a terminal board 2 for supplying the device. More specifically, device 1 is designed for use on a known electric household appliance (not shown) such as a gas cooker or cooking range with gas burners or a gas oven lit electrically.

Device 1 comprises a casing 3 made of insulating material; electronic high-voltage-pulse generating means 4 (known and therefore not described in detail for the sake of simplicity) in turn comprising one or more transformers 5, each having a secondary winding 6 (FIG. 1), the ends of which are connected to respective known high-voltage terminals 8 (FIG. 2); and assembly means, defined by teeth 9 and 10, for fitting insulating casing 3 removably to a supporting surface 11 of a conducting metal body element 12 of an electric household appliance, in particular defined by a cooking range with known gas burners (not shown for the sake of simplicity).

According to the invention, casing 3 is fitted directly with supply contacts 15, 16 located on a specially shaped portion 18 of the casing, so that contacts 15, 16 and portion 18 form a supply terminal board 2 fully and closely integrated with the gas-lighting device, and which, as will be seen, is connected exclusively and solely to electronic high-voltage-pulse generating means 4, and is designed to receive the wires of a known supply cable (not shown for the sake of simplicity)

More specifically, the casing is made of molded synthetic plastic material, and comprises a cup-shaped body 19, a cavity 20 of which houses transformer/s 5 (in the example shown, two transformers 5); and portion 18, which is substantially in the form of a parallelepiped-shaped box and is formed integrally with cup-shaped body 19. Box portion 18 has a bottom wall defining two opposite faces: an outer face 21 facing, in use, surface 11 of body 12; and an inner face 22. On the face 22 side, box portion 13 houses at least part of said electronic high-voltage-pulse generating means 4 (shown schematically by a dash line), including at least part of a known printed circuit 25 (or connecting board supporting an electric track circuit), and is fitted directly on face 22 with said supply contacts 15 and 16.

Contacts 15, 16 are defined by Faston blade contacts clicked in known manner, not shown, onto face 22 and each having a respective known screw terminal for receiving both terminated and nonterminated wires.

Teeth 9 are substantially rigid and L-shaped, while tooth 10 is elastically deformable, so that all click in known manner onto opposite edges of the same opening, or, as in the example shown, onto respective through openings 30, 31 in metal body element 12 of the appliance. Teeth 9, 10 are formed integrally with casing 3 and project perpendicularly from face 21.

Contact 16, between two contacts 15, is a ground contact and, according to one aspect of the invention, comprises an integral T-shaped tongue 33 which projects outwards of box portion 18, is bent into an L to extend longitudinally parallel to and facing face 21, on the same side as teeth 9, 10, and is separated from face 21 by such a distance as to contact surface 11 when teeth 9, 10 engage openings 30, 31. Tongue 33 also comprises two (or at least one) known fastening holes 35 for fitment to metal body element 12 of the appliance. The above design and location of tongue 33 between teeth 9 and 10 enable use of the tongue to ground body element 12 with no increase in the normal overall transverse size of casing 3, thus enabling device 1 to be fitted to the appliance from both the inside and outside.

According to a further aspect of the invention, box portion 18 comprises, on the face 21 side, an integral connector 37 (e.g. a JST type) for connecting electronic high-voltage-pulse generating means 4 to respective known control means (not shown) of the appliance.

In conjunction with the above characteristic, cup-shaped body 19 comprises an access opening 38 to cavity 20, and a bottom wall 39 opposite and facing opening 38, both of which lie in planes perpendicular to the plane of faces 21 and 22 of box portion 18, i.e. are oriented 20 perpendicular to faces 21 and 22. Bottom wall 39 comprises a number of through ducts 40, each housing a terminal 8, so that terminals 8 and contact 16 face opposite ways, thus preventing crossover of the respective connected wires.

Finally, portion 18 may comprise a known cable clamping device 50, shown only schematically, to complete terminal board 2.

What is claimed is:

1. An electronic gas-lighting device, comprising:

a casing made of insulating material;

an electronic high-voltage-pulse generating circuit housed in said casing, said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit; and attaching elements for removably attaching said casing to a supporting surface of a metal conducting body element of a cooking range provided with gas burners;

wherein said attaching elements comprise two teeth adapted to engage with at least one opening of the metal conducting body element, said teeth being formed integrally with said casing and at least one of said teeth being elastically deformable, both of said teeth projecting in the same direction from the same side of said casing;

wherein said casing comprises first and second compartments, said transformer being housed in the first compartment and electrically connected to other components of said electronic high-voltage-pulse generating circuit that are housed in the second compartment, said power supply contacts being fitted to the second compartment, wherein said teeth project integrally from an outer surface of the second compartment; and wherein one of said power supply contacts is a ground contact that comprises a tongue projecting outwards of the second compartment, on the same side as the teeth, for a predetermined distance from the outer surface so as to contact the metal conducting body element when said teeth engage said at least one opening of the metal conducting body element.

2. The device of claim 1, wherein an entirety of said casing, including said first and second compartments, is integrally made of molded plastic material.

3. The device of claim 2, wherein said first compartment has a cup structure, said second compartment has a box structure, and said power supply contacts include blade contacts each having a screw terminal.

4. The device of claim 2, wherein, said tongue has a hole for enabling said tongue to be fastened to the metal conducting body element.

5. The device of claim 4, wherein said first compartment has a cup structure, said second compartment has a box structure, and said power supply contacts include blade contacts each having a screw terminal.

6. The device of claim 1, wherein the first compartment has an access opening; and a bottom wall opposite and facing said access opening, said bottom wall comprising at least one duct in which said at least one high voltage terminal is housed, said bottom wall and access opening lying in planes perpendicular to the outer surface of said second compartment.

7. An electronic gas-lighting device, comprising:

a casing made of insulating material, an electronic high-voltage-pulse generating circuit housed in said casing, said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit, and attaching elements for removably attaching said casing to a supporting surface of a metal conducting body element of a cooking range provided with gas burners;

wherein said attaching elements comprise two teeth adapted to engage with at least one opening of the metal conducting body element, said teeth being formed integrally with said casing and at least one of said teeth being elastically deformable, both of said teeth protecting in the same direction from the same side of said casing;

said casing comprises first and second compartments, said transformer being housed in the first compartment and electrically connected to other components of said electronic high-voltage-pulse generating circuit that are housed in the second compartment, said power supply contacts being fitted to the second compartment; and said teeth project integrally from an outer surface of the second compartment; and said device further comprises comprising a conductor on the outer surface of said second compartment for connecting the electronic high-voltage-pulse generating circuit to a control of the cooking range.

8. The device of claim 7, wherein an entirety of said casing, including said first and second compartments, is integrally made of molded plastic material.

9. An electronic gas-lighting device, comprising:

a casing made of insulating material;

an electronic high-voltage-pulse generating circuit housed in said casing, said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit; and attaching elements for removably attaching said casing to a supporting surface of a metal conducting body element of a cooking range provided with gas burners;

wherein said casing comprises first and second compartments, said transformer being housed in the first compartment and electrically connected to other components of said electronic high-voltage-pulse generating circuit that are housed in the second compartment, said power supply contacts being fitted to the second compartment; and an entirety of said casing, including said first and second compartments, is integrally made in one piece from said insulating material.

10. The device of claim 9, wherein said attaching elements projecting generally in the same direction from an outer surface of the second compartment.

11. An electronic gas-lighting device, comprising:

a casing made of insulating material;

an electronic high-voltage-pulse generating circuit housed in said casing said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit; and attaching elements for removably attaching said casing to a supporting surface of a metal conducting body element of a cooking range provided with gas burners;

wherein said casing comprises first and second compartments, said transformer being housed in the first compartment and electrically connected to other components of said electronic high-voltage-pulse generating circuit that are housed in the second compartment, said power supply contacts being fitted to the second compartment;

said attaching elements comprise two teeth adapted to engage with at least one opening of the metal conducting body element, said teeth being formed integrally with said casing, both of said teeth projecting from one side of said casing;

one of said power supply contacts is a ground contact that comprises a tongue projecting outwards of the second compartment, on the same side as the teeth, for a predetermined distance from the outer surface so as to contact the metal conducting body element when said teeth engage said at least one opening of the metal conducting body element.

12. The device of claim 11, wherein said high voltage terminal and said tongue project from the first and second compartments, respectively, in substantially perpendicular directions.

13. The device of claim 11, wherein said teeth project generally in the same direction from said one side of said casing and said tongue is positioned between said teeth.

14. The device of claim 11, wherein an entirety of said casing, including said first and second compartments, is integrally made of said insulating material.

15. An electronic gas-lighting device, comprising:

a casing made of insulating material;

an electronic high-voltage-pulse generating circuit housed in said casing, said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit; and attaching elements for removably attaching said casing to a supporting surface of a metal conducting body element of a cooking range provided with gas burners;

wherein said attaching elements comprise two teeth adapted to engage with at least one opening of the metal conducting body element, said teeth being formed integrally with said casing and at least one of said teeth being elastically deformable;

one of said power supply contacts is a ground contact that comprises a tongue made of conducting material and adapted to contact the metal conducting body element when said teeth engage said at least one opening of the metal conducting body element; and said tongue is positioned between said teeth.

16. The device of claim 15, wherein both of said teeth and said tongue project in the same direction from the same side of said casing.

17. An electronic gas-lighting device, comprising:

a casing made of insulating material, an electronic high-voltage-pulse generating circuit housed in said casing, said electronic high-voltage-pulse generating circuit comprising a transformer having a secondary winding and at least one high voltage terminal formed at an end of said secondary winding;

power supply contacts fitted to said casing to be in electrical contact with said electronic high-voltage-pulse generating circuit; and attaching elements for removably attaching said casing to a supporting surface of a metal conducting body element of a cooking range provided with gas burners;

wherein said attaching elements comprise two teeth adapted to engage with at least one opening of the metal conducting body element, said teeth being formed integrally with said casing and at least one of said teeth being elastically deformable, both of said teeth protecting in the same direction from the same side of said casing, and said power supply contacts are blade contacts each having a screw terminal, one of said blade contacts being a grounding contact;

said device further comprising an L-shaped tongue having a first portion extending from the grounding contact in a direction of the supporting surface of the metal conducting body element when said teeth engage said at least one opening of the metal conducting body element, and a second portion substantially parallel to the supporting surface of the metal conducting body element when said teeth engage said at least one opening of the metal conducting body element.

18. An electronic gas lighting device integrated with a terminal board, the device comprising:

a casing made of insulating material;

electronic high voltage pulse generating means including at least one transformer having a secondary winding which has ends connected to respective high voltage terminals; and assembly means for removably fitting said casing to a supporting surface of a conducting metal body element of a cooking range with gas burners;

wherein said casing is fitted directly with respective supply contacts located on a specially shaped portion of the casing to form a supply terminal board, which is connected exclusively and solely to said electronic high voltage pulse generating means, and to which are connectable wires of a supply cable;

said casing is made of molded synthetic plastic material;

said casing comprises a cup shaped body, a cavity of which houses said at least one transformer, and a box portion, which is formed integrally with the cup shaped body;

said casing houses at least part of said electronic high voltage pulse generating means, and is fitted directly with said respective supply contacts which are arranged on the box portion to form, together with the box portion, said terminal board;

said respective supply contacts being defined by Faston blade contacts clicked onto an inner first face of said box portion of the casing, and each having a respective screw terminal;

said assembly means comprise two teeth, at least one of which is elastically deformable, and which click onto at least one opening in said conducting metal body element of the cooking range;

said teeth are formed integrally with said casing, and project perpendicularly from an outer second face, opposite the first face, of said box portion of the casing;

one of said respective supply contacts is a ground contact, and comprises an integral tongue projecting outwards of the box portion of the casing on the same side as said teeth, said tongue being located parallel to and facing said second face, and at such a distance from the second face as to contact said conducting metal body element of the cooking range when said teeth engage said at least one opening; and said tongue has at least one respective fastening hole for fitment to said conducting metal body element of the cooking range.

19. The device of claim 18, wherein, on said second face side, said box portion of the casing comprises an integral connector for connecting the high voltage pulse generating means to respective control means of the cooking range.

20. The device of claim 19, wherein said cup shaped body comprises an access opening to said cavity, and a bottom wall opposite and facing said access opening and comprising a number of through ducts, each housing one of said high voltage terminals; said bottom wall and said access opening lying in planes perpendicular to the plane of said first and second faces of the box portion.

* * * * *